US005884608A

United States Patent [19]

Cooke

[11] Patent Number: 5,884,608

[45] Date of Patent: Mar. 23, 1999

[54] FUEL PUMP

[75] Inventor: Michael Peter Cooke, Kent, United Kingdom

[73] Assignee: Lucas Industries, Plc, Solihull, England

[21] Appl. No.: 958,003

[22] Filed: Oct. 27, 1997

[30] Foreign Application Priority Data

Jan. 30, 1997 [GB] United Kingdom ..... 9701877

[51] Int. Cl.[6] ..... F02M 37/04

[52] U.S. Cl. ..... 123/495; 417/470

[58] Field of Search ..... 123/495; 417/470, 417/529; 92/68

[56] References Cited

U.S. PATENT DOCUMENTS

| | | | |
|---|---|---|---|
| 2,271,570 | 2/1942 | Pardee | 103/174 |
| 2,770,972 | 11/1956 | Gratzmuller | 74/49 |
| 3,175,758 | 3/1965 | Dirk . | |
| 4,071,010 | 1/1978 | Miller | 123/495 |
| 4,501,294 | 2/1985 | Bormioli | 92/68 |
| 4,874,297 | 10/1989 | Collins | 417/265 |
| 5,382,140 | 1/1995 | Eisenbacher | 417/273 |
| 5,529,466 | 6/1996 | Tackett | 417/529 |

FOREIGN PATENT DOCUMENTS

| | | |
|---|---|---|
| 72.07011 | 10/1973 | France . |
| 3803735 A1 | 8/1989 | Germany . |
| 0 821 156 A2 | 1/1998 | United Kingdom . |

*Primary Examiner*—Thomas N. Moulis

*Attorney, Agent, or Firm*—David P. Gordon; David S. Jacobson; Thomas A. Gallagher

[57] ABSTRACT

This invention relates to a fuel pump, and more particularly to a fuel pump for delivering high pressure fuel to a fuel injection system of an internal combustion engine. A fuel pump is provided comprising coupling means (30) mechanically coupling a first pump plunger (1) to a second drive means (14) and a second pump plunger (11) to a first drive means (4) whereby, when the first pump plunger (1) is driven by the first drive means (4) from bottom dead center to top dead center, the second pump plunger (11) is driven by the coupling means (30) from top dead center to bottom dead center, and as the second pump plunger (11) is driven from bottom dead center to top dead center by the second drive means (14), the first pump plunger (1) is driven from top dead center to bottom dead enter by the coupling means (30). The use of a mechanical coupling means eliminates the problem of stroke limitation and speed limitation inherent in the use of springs as a means of returning the pump plungers to their bottom dead center positions.

17 Claims, 4 Drawing Sheets

FUEL PUMP

BACKGROUND OF THE INVENTION

1. Field of the Invention

This invention relates to a fuel pump, and more particularly to a fuel pump for delivering high pressure fuel to a fuel injection system of an internal combustion engine. The preferred embodiment of the present invention is particularly suitable for supplying high pressure fuel to an accumulator or directly to the common rail of a common rail fuel injection system, but the invention is not limited to this application.

2. State of the Art

There are various characteristics which are recognised by those skilled in the art as being desirable in fuel pumps for fuel injection systems, particularly high pressure fuel pumps for use in common rail fuel injection systems. One such characteristic is the presence of a low dead (unswept) volume associated with the or each pumping plunger.

In order to minimise the dead volume associated with a pumping plunger it is known to obviate the need for an inlet valve at the discharge end of the plunger cylinder by providing a fill passage which opens into the cylinder immediately above the position of the end of the pump plunger when the pump plunger is at its bottom dead centre (bdc) position. With such an arrangement, as the pump plunger moves away from its bdc position it covers the fill passage and permits pressurization of the fuel trapped between the pump plunger and the discharge end of its associated cylinder. During the return stroke of the pump plunger a discharge valve prevents reverse flow of the fuel and a vacuum is created within the pumping cylinder until the fill passage is again uncovered by the pump plunger whereupon fuel may flow into the cylinder under the combined influences of the feed pressure in the fill passage and the vacuum created by the previous plunger movement. Whilst this design offers the advantage of a very small dead volume, it does suffer from the disadvantage of requiring a substantial force to move the plunger from its top dead centre (tdc) position to its bdc position because of plunger inertia and the vacuum which is created within the pumping cylinder during such movement. In known designs, a spring is used to move the plunger from tdc to bdc. The provision of this spring limits the design of the pump, and in particular, limits the ability of the designer to increase the stroke of the pump plunger to increase the output of the pump. This is because it is not possible to engineer a spring which can provide sufficient force, stroke and velocity characteristics at high engine speeds if the stroke of the pump plunger is too long.

SUMMARY OF THE INVENTION

The preferred embodiment of the present invention overcomes the limitation referred to above by providing an alternative means of moving the pump plunger from the tdc to the bdc position, thereby allowing a longer stroke to be achieved at high engine speed than has previously been possible. The use of a long stroke enables a high delivery volume to be achieved for a relatively small plunger diameter. Reduction in plunger diameter is desirable since it reduces the force and hence the bearing loads necessary to drive the pump plunger and, by reducing the peripheral sealing area between the plunger and its associated cylinder, reduces leakage of fuel past the plunger.

According to one aspect of the present invention a fuel pump comprises first and second pump plungers slidably mounted in respective first and second cylinders to define respective first and second pumping chambers; first drive means for driving the first pump plunger from a bottom dead centre position to a top dead centre position to deliver fuel from the first pumping chamber; second drive means for driving the second pump plunger from a bottom dead centre position to a top dead centre position to deliver fuel from the second pumping chamber; and coupling means mechanically coupling the first pump plunger to the second drive means and the second pump plunger to the first drive means whereby when the first pump plunger is driven by the first drive means from bottom dead centre to top dead centre the second pump plunger is driven by the coupling means from top dead centre to bottom dead centre and as the second pump plunger is driven from bottom dead centre to top dead centre by the second drive means the first pump plunger is driven from top dead centre to bottom dead centre by the coupling means.

The use of a mechanical coupling means for driving the pistons from tdc to bdc obviates the need for the return springs conventionally used for this purpose and accordingly eliminates the problem of stroke limitation and speed limitation inherent in the use of springs as the means for returning the pump plungers from their tdc positions to their bdc positions.

Preferably, the coupling means comprises a rocker arm pivotally mounted on a shaft secured to the body of the pump. Preferably, each pump plunger includes a head one side of which is acted on by the associated drive means to drive the pump plunger from bdc to tdc and the other side of which acts on the rocker arm as the plunger moves from bdc to tdc.

Preferably, a slipper member is interposed between the said other side of the head and the rocker arm to accommodate movement of the rocker arm laterally of the axis of the pump plunger as the pump plunger reciprocates. Preferably, the slipper member has a flat face in engagement with the said other side of the pump plunger and a spherical seat which engages a complementary spherical surface of the rocker arm.

Preferably, the drive means each comprise a cam driven tappet. Preferably, a second slipper member is interposed between each tappet and the said one side of its associated pump plunger. Preferably, the said one side of the pump plunger is spherical in the zone where it is engaged by the second slipper member, and the second slipper member has a spherical surface complementary to that of the said one side of the pump plunger head.

Preferably, the respective drive means have respective cam members mounted axially displaced from each other on a common drive shaft. Preferably, the profiles of the respective cams are such that as each pump plunger is driven from bdc to tdc the tappet of the other pump plunger is maintained in or very close to sliding contact with its associated cam by the action of the coupling means.

Preferably, the position of the coupling means is adjustable to eliminate significant backlash between the various mechanical components of the pump plunger drive system. In the case of the preferred embodiment of the invention where the coupling means is in the form of a rocker arm, the rocker shaft is preferably mounted by means of an eccentric on the pump body so that rotation of the rocker shaft is effective to adjust the position of the rocker arm to eliminate backlash.

Preferably, each pumping chamber has associated therewith an electrically controlled discharge valve which may be held open for a selectively variable portion of each return (i.e. tdc to bdc) stroke of its associated pump plunger. By this means, the volumetric output of the pump may be regulated without the need to vary the stroke of the pump plungers or spill high pressure fuel from the pump delivery to reservoir.

According to another aspect of the present invention a fuel injection system for an internal combustion engine comprises a fuel pump, a common rail to which high pressure fuel is delivered by the pump, a plurality of injection valves; a fuel injection nozzle associated with each fuel injection valve, the fuel injection nozzles requiring a pre-determined minimum rail pressure to open; and a safety valve fluidically connected to the common rail, the safety valve having a pre-determined opening pressure and a pre-determined closure pressure less than the opening pressure, the pre-determined closing pressure being below the minimum rail pressure required to open the fuel injection nozzles.

With such a system, if as a result of control failure the pressure in the common rail exceeds a pre-determined safety limit sufficient to open the safety valve, the safety valve will remain open until the pressure in the common rail has decayed below the level necessary to open the fuel injection nozzles and accordingly the engine will stop.

Preferably, the safety valve is incorporated within a fuel injection pump.

Preferably, the fuel injection pump includes a flow restriction device which limits the rate of flow of fuel from the common rail or accumulator supplied by the pump in response to opening of the safety valve or the controlled maintenance of an open state of the discharge valves.

The above and further features and advantages of the invention will become clear from the following description of a preferred embodiment thereof, given by way of example only, reference being had to the accompanying drawings:

DETAILED DESCRIPTION OF THE PREFERRED EMBODIMENT

Figure 1:
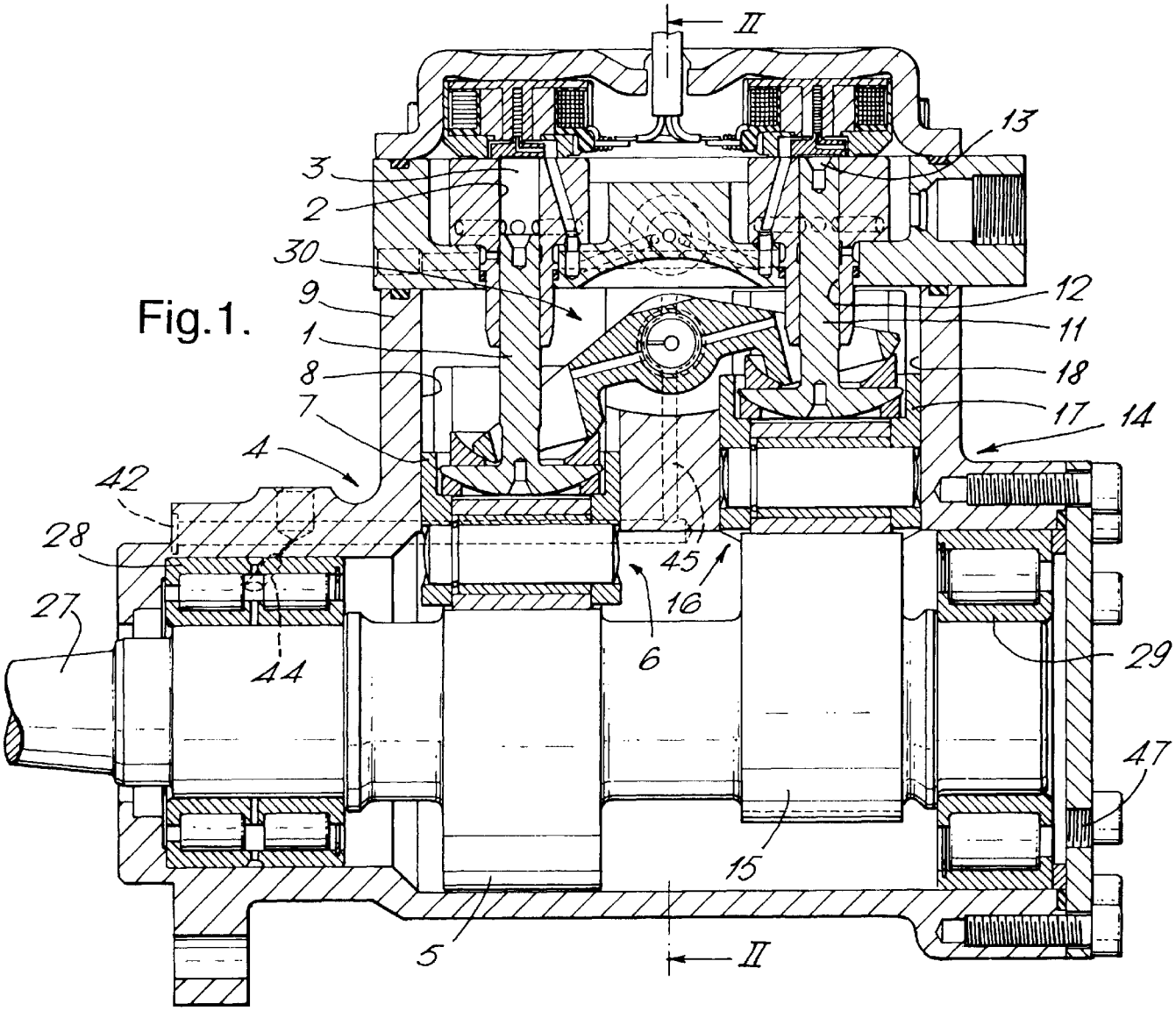
FIG. 1 is a longitudinal view, partly in cross-section, of a preferred embodiment of the invention.

The fuel injection pump of the preferred embodiment comprises a first pump plunger 1 and a second pump plunger 11. The pump plungers 1,11 are slidably mounted in respect of the first and second cylinders 2,12 to define respective first and second pumping chambers 3,13. As illustrated in the drawings the first pump plunger 1 is at a bdc position and accordingly the volume of its associated pumping chamber 3 is at a maximum, whilst the second pump plunger 11 is at a tdc position so that the volume of its associated pumping chamber 13 is at a minimum. A first drive means 4 is provided for driving the first pump plunger from its bdc to its tdc positions. A second drive means 14 is provided for driving the second pump plunger from its bdc to its tdc position. The first drive means comprises a cam 5 and a tappet assembly 6 comprising a tappet shell 7 which is slidably mounted in a guide bore 8 provided in the body 9 of the pump. The second drive means 14 comprises a cam 15 and tappet assembly 16 comprising a tappet shell 17 mounted in a bore 18 in the body 9. The first and second drive means are substantially identical and for the purposes of further description only the components of the second drive means will be referred to. It is to be understood, however, that the corresponding components of the first drive means are substantially identical to those which we described in relation to the second drive means.

Figure 3:
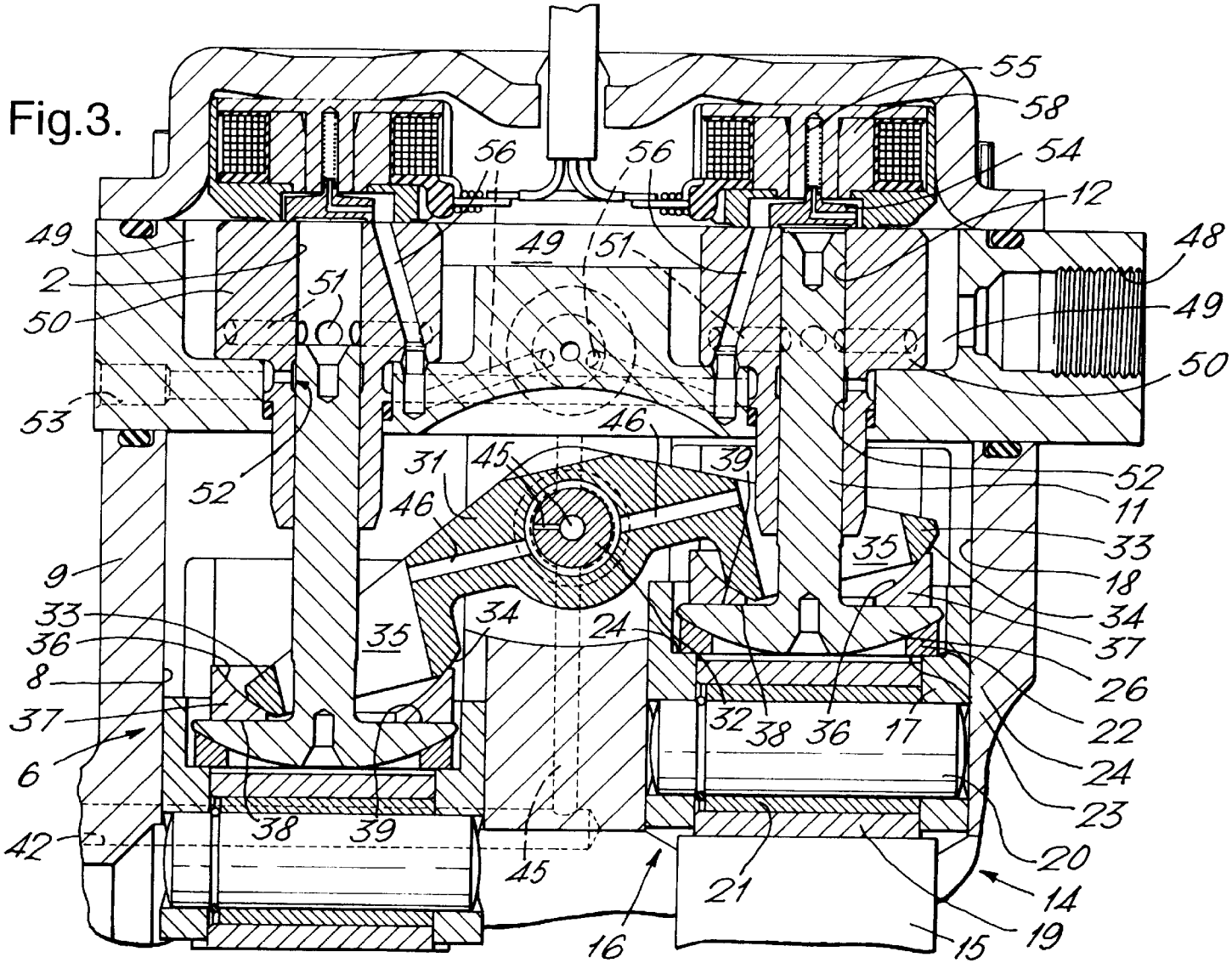
FIG. 3 is an enlarged view of a portion of the pump of FIG. 1.

Referring now to FIG. 3, the second drive means 14 includes a roller 19 which is rotatably mounted on a pin 20 which is secured to the tappet shell 17. An appropriate bearing 21 is interposed between the pin 20 and the roller 19. The roller 19 is in rolling engagement with the surface of the cam 15.

A first slipper member 22 has a flat lower surface 23 which slidingly engages a flat shoulder 24 provided on the tappet shell. The external diameter of the slipper member 22 is somewhat less than the internal diameter of the tappet shell at that point whereby some lateral movement of the slipper member relative to the tappet shell can be accommodated. The upper surface of the slipper member 22 is part-spherical and mates with a corresponding part-spherical lower surface of a head 26 which is formed integrally with the second pump plunger 11.

It will be appreciated from the above description that upward movement of the roller 19 (as viewed in FIG. 3) will produce an upward force on the pin 20 which will be transferred to the tappet shell 17 and from there, via the slipper member 22, to the head 26 of the pump plunger 11. The entire tappet assembly 16 will slide upwardly in the bore 18 and the pump plunger will be moved from its bdc position to its tdc position.

Figure 2:
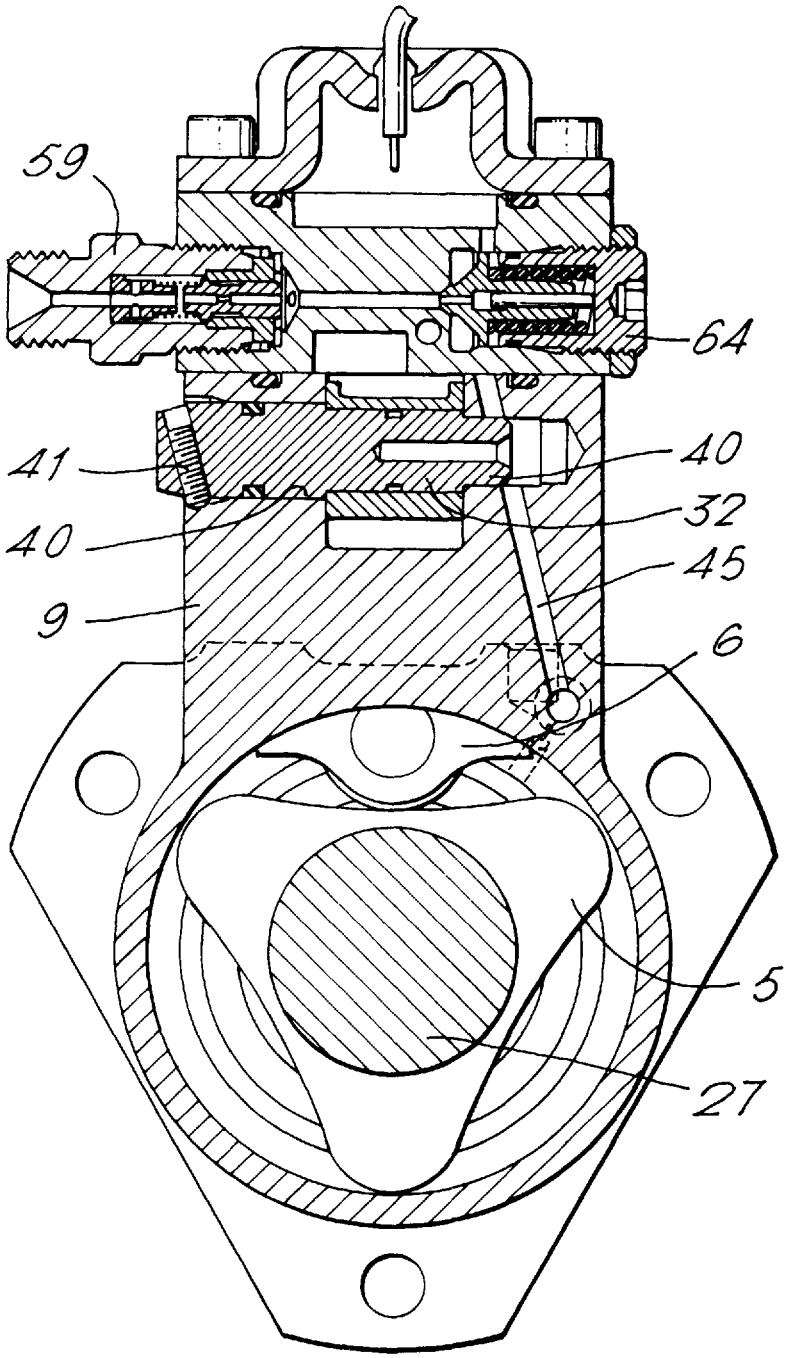
FIG. 2 is a cross-section of FIG. 1 on the line II—II thereof.

The cams 5,15 are identical and are mounted on a common shaft 27 which is itself mounted in the body 9 by bearings 28,29. As best seen in FIG. 2 the cams 5,15 are each three lobe cams. The cams 5,15 are rotationally out of register with each other by 120°. This particular arrangement of cams provides a total of six pumping strokes per revolution of the shaft 27. It is to be understood, however, that the invention is not limited to this arrangement and that other cam profiles may be used as appropriate.

In order to move the pump plungers 1,11 from their respective tdc positions to their respective bdc positions coupling means 30 are provided for coupling the first pump plunger 1 to the second drive means 14 and for coupling the second pump plunger 11 to the first drive means 4. The coupling means comprise a rocker arm 31 mounted on a shaft 32 which is itself secured to the body 9. The rocker arm 31 has end regions 33 each of which define a part-spherical thrust surface 34 and an aperture 35 through which a respective one of the pump plungers extends. The thrust surfaces 34 are each part-spherical and mate with corresponding part-spherical seats 36 provided on slipper members 37 each of which has a flat lower surface 38 which is in sliding contact with a flat upper surface 39 of a respective one of the heads 26.

With this arrangement, as one of the pump plungers (say the pump plunger 1) is driven from bdc to tdc by its associated drive means, a force will be transmitted from the upper surface 39 of the pump plunger via the associated slipper member 37 to the rocker arm 31 and will cause the rocker arm to rotate thereby driving the other pump plunger via the interposed slipper member 37 from tdc towards bdc. Accordingly, as one pump plunger executes its delivery stroke the other pump plunger will be forced to execute a filling stroke by virtue of the action of the coupling means.

Satisfactory movement of the pump plungers may therefore be secured without the use of the return spring.

It will be appreciated that in order to effect the required movement of the pump plungers the profiles of the cams 5,15 must be complementary to each other so that the upward movement of the tappet assembly 6 is exactly mirrored by the corresponding downward movement of the other tappet assembly 16, and vice versa, without either of the rollers 19 coming out of contact with the surface of their associated cams by more than a minimal amount. In practice cam form tolerances usually mean that some lift-off will inevitably occur during some part of the motion, but this is only a small fraction of a millimetre. It will further be appreciated that the entire mechanism is preferably adjusted so that there is no more than the necessary working clearances between the various components—i.e. so there is no backlash in the drive system. To achieve this arrangement, and to permit subsequent adjustment to compensate possible wear of the components, the rocker shaft 32 is somewhat eccentric relative to the mounting holes 40 in which it is mounted in the body 9. Accordingly, by rotating the rocker shaft 32 the pivot axis of the rocker arm 31 may be moved upwardly and downwardly through a small range. A grub screw 41 is provided for locking the rocker shaft 32 in its adjusted position. It will be noted that this means of adjustment of the rocker shaft will produce some lateral movement of the pivot axis of the rocker arm 31 as the vertical position of the pivot axis is adjusted. However, this lateral movement will be accommodated by lateral sliding movement of the slipper members 37 on the upper surface 39 of the respective heads 26. It will also be noted that any misalignment between the cylinders 2,12 and the bores 8,18 of the associated tappet assemblies 6,16 will be accommodated by lateral movement of the slipper members 22 on the shoulders 24 of the tappet shells 7,17. Accordingly, the arrangement of two slipper members 22 and 37 associated with each of the pump plungers permits both adjustment of the rocker arm 31 by relatively simple mechanism and allows for any misalignment between the various bores of the pump.

In order to lubricate the rocker arm and the various slipper members means are preferably provided to supply lubricating oil under pressure to an oil feed 42 provided in the body. A passage 44 connects the oil feed to the front bearing 28 and a passage 45 connects the oil feed 42 to the external surface of the rocker shaft 32. Drillings 46 provided in the rocker arm carry lubricant to various sliding surfaces of the slipper members and tappet assemblies. A suitable return passage for lubricating oil, for example via an outlet 47 in the pump body is provided for returning lubricating oil to the associated engine sump.

Fuel to be pumped is supplied, for example, from a transfer pump, to a fuel inlet 48 which is connected to a gallery 49 which surrounds the cylinder members 50 which define the cylinders 2,12. Each cylinder member 50 includes a multiplicity of radially extending bores 51 which connect the gallery 49 to the associated cylinder 2,12. The radial bores 51 are positioned so that, during the majority of the stroke of the associated pump plunger, the inner ends of the radial bore are covered by the body of the pump plunger. The inner ends of the bores 51 are exposed to the pumping chambers 3,13 only when the corresponding pump plunger is at or near its bdc position. An annular groove 52 is formed in each cylinder member 50 slightly below the radial bores 51. The annular grooves 52 are connected to a low pressure fuel return passage 53 so that any fuel escaping from the pumping chambers 3,13 past the pump plungers 1,11 will be directed to the fuel return passage 53 rather than entering the interior of the pump where it would become mixed with lubricating oil.

Figure 4:
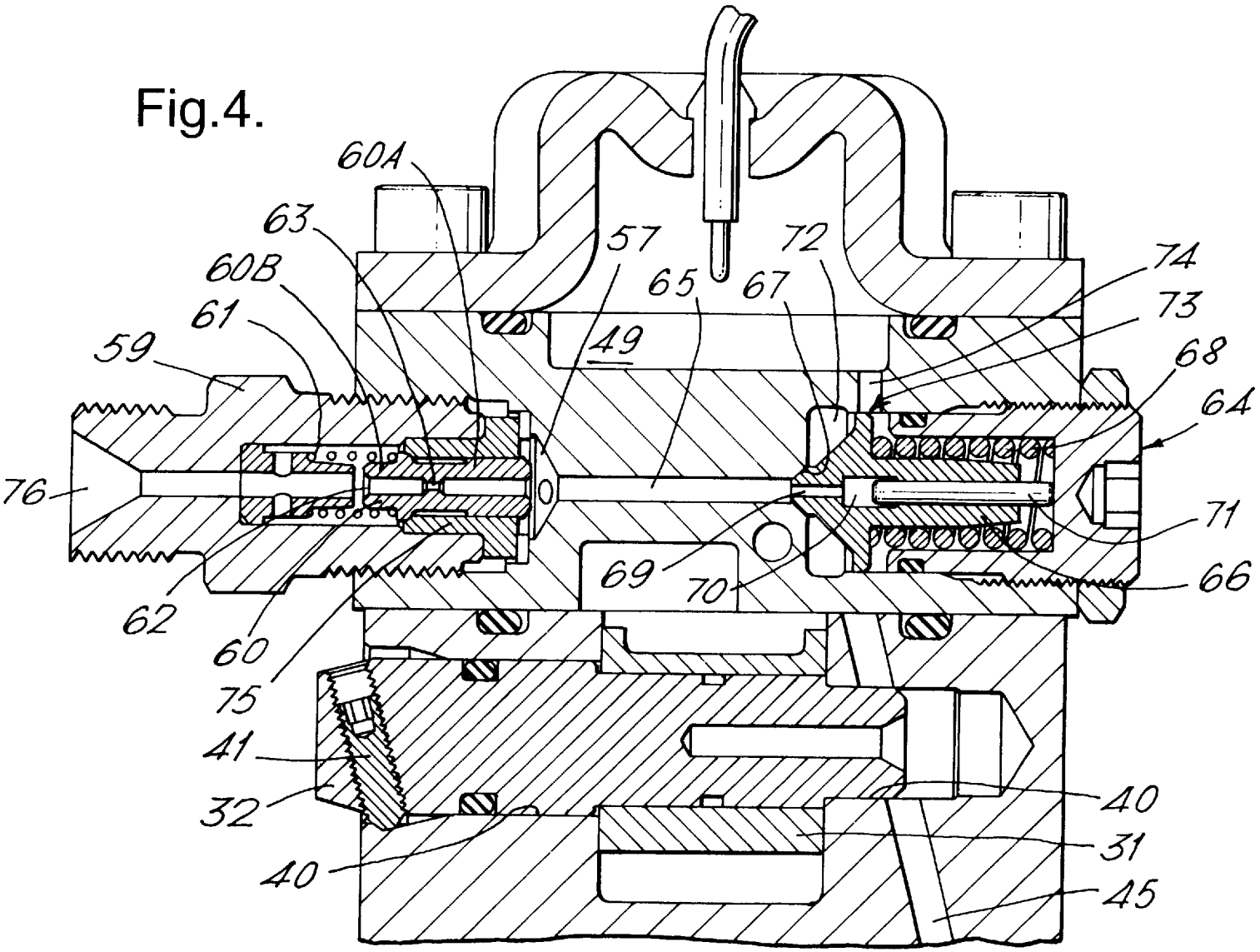
FIG. 4 is an enlarged view of a portion of the pump of FIG. 2.

Each pumping chamber 3,13 has, at the upper end thereof (as viewed in FIG. 3) a valve member 54 which is normally biassed into engagement with the upper surface of the adjacent cylinder member 50 by a light spring 55. During each pumping stroke (bdc to tdc) of a pump plunger the associated valve member 54 will be lifted by fuel discharged from the pumping cylinder to allow the fuel to flow via transfer passages 56 to an outlet gallery 57 (FIG. 4). Each valve member 54 has associated therewith an electro-magnet 58 which, when energised, is capable of holding its associated valve member 54 away from the adjacent cylinder member 50—i.e. is capable of holding the delivery valve open. The electro-magnets are selectively energised by appropriate control means to control the delivery flow from the pump. More particularly, at the end of each delivery stroke of each pump plunger the associated electro-magnet 58 is energised to hold the delivery valve member 54 open for part of the return (tdc to bdc) stroke of the pump plunger. Accordingly, during the initial portion of the return stroke of the pump plunger fuel will flow into the pumping chamber 3 or 13 from the associated transfer passage 56 past the valve member 54. At an appropriate point of the return stroke the electro-magnet 58 will be de-energised allowing the valve member 54 to move under the combined effects of its associated spring 55 and fuel flow into engagement with the adjacent surface of the cylinder member 50. Thereafter, no further reverse flow of fuel from the transfer passage 56 will be possible and further movement of the pump plunger towards its bdc position will produce a vacuum within the associated pumping chamber until the radial bores 51 are exposed, whereupon fuel from the feed gallery 49 will flow into the pumping chamber ready for the commencement of the next delivery stroke. It will be appreciated that the electro-magnets 58 will be controlled by appropriated control circuitry in light of fuel usage.

For maximum delivery the electro-magnets 58 will not be energised at all with the result that there will be minimal reverse flow of fuel from the transfer passages 56 to the pumping chambers as the pump plungers move from tdc to bdc. At the other extreme, if it is desired to reduce the pressure in the accumulator or common rail fed by the pump the electro-magnets 58 may be continuously energised through several pumping cycles. If this occurs, when a pump plunger is at or close to the bdc position fuel may flow from the accumulator or common rail into the outlet gallery 57 and then via the transfer passages 56 and pumping chambers 3,13 to the radial bores 51 and hence the relatively low pressure supply gallery 49. The electro-magnets accordingly provide a means of dumping pressure for the accumulator or common rail without providing a separate unloader valve.

If this facility is required in a particular installation an appropriate snubber valve assembly 59 may be provided between the outlet gallery 57 and the accumulator or common rail in order to limit the possible flow rate of fuel from the accumulator/common rail to the outlet gallery 57. As will be appreciated by those skilled in the art the snubber valve 59 includes a spool 60 the right hand end 60A (as viewed in FIG. 4) of which is externally fluted and the left hand end 60B of which normally engages a seat formed on a sleeve 75 in which the spool is slidably mounted. In use, when fuel pressure in the gallery 57 exceeds that at the valve outlet 76 the spool will be lifted off the seat against the force of a light spring 61 and fuel will flow substantially unrestricted from the outlet gallery 57 via the spool flutes to the valve outlet 76. The spool 60 includes a central bore 62 having a restriction 63 which restricts flow of fluid from the accumulator/common rail to the outlet gallery 57 when the pressure in the accumulator/common rail exceeds that in the outlet gallery 57.

It will be appreciated from the above description that if electrical power to the electro-magnets 58 is lost, or one of the electro-magnets fails, the pump (or at least the pumping chamber associated with the failed electro-magnet) will automatically produce to its maximum possible delivery. In a system in which there is no safety valve to control the maximum pressure in the accumulator/common rail such failure could result in an excessively high pressure being generated in the accumulator/common rail. To guard against this possibility the pump preferably incorporates a safety valve 64 (FIG. 4). The safety valve 64 is connected by a passage 65 to the outlet gallery 57 and comprises a valve member 66 which is normally biassed into engagement with an associated seat 67 by a spring 68. A small passage 69 in the valve member connects the passage 65 to an internal chamber 70 which is bounded at one end by a pin 71 which is slidably mounted in a bore provided by the valve member 66. The effect of this arrangement is that the outlet fuel pressure acts on the valve member 66 only over an annular area equal to the difference in diameter of the passage 65 and the pin 71. This arrangement allows a relatively large diameter valve seat to be provided without causing an excessively large force to be generated on the valve member 66 by the outlet fuel pressure acting over the area of the seat.

If the outlet fuel pressure acting over the annular area referred to above produces a force which exceeds that of the valve spring 68 the valve member 66 will lift off the seat 67 and fuel at outlet pressure will be admitted to a chamber 72 which is defined from in the pump body and bounded on one side of the head 73 of the valve member 66. The high pressure fuel in the chamber 72 will act over the entire area of the head 73 (less the area of the pin 71) to move the valve member 66 rapidly away from the seat 67 to connect the chamber 72 to a passage 74 leading to the relatively low pressure feed gallery 49. Fuel from the common rail/accumulator may accordingly flow via the snubber 59, gallery 57, passage 65, chamber 72 and passage 74 to the gallery 49.

Once the valve member 66 has been lifted from its seat it will not be able to re-seat until the spring 68 is able to overcome the force generated by fuel within the chamber 72 acting over the area of the head 73 minus the area of the pin 71. Since the area of the head 73 is large the result of this arrangement is that the valve member 66 will be unable to re-seat until the pressure in the passage 65 has fallen to a low value. By appropriate design of the components the pressure value at which the valve member 66 will be able to re-seat may be made lower than the pressure necessary to open the fuel injection nozzles of the engine fed by the pump. Thus, once the safety valve has opened in response to an over-pressure condition the safety valve will stay open until the engine stops. The safety valve 64 accordingly provides an automatic means for stopping the associated engine if an over-pressure condition in the accumulator or common rail occurs.

I claim:

1. A fuel pump comprising first and second pump plungers (1,11) slidably mounted in respective first and second cylinders (2,12) to define respective first and second pumping chambers (3,13); first drive means (4) for driving the first pump plunger 1 from a bottom dead centre position to a top dead centre position to deliver fuel from the first pumping chamber (3); second drive means (14) for driving the second pump plunger (11) from a bottom dead centre position to a top dead centre position to deliver fuel from the second pumping chamber (13); and coupling means (30) mechanically coupling the first pump plunger (1) to the second drive means (14) and the second pump plunger (11) to the first drive means (4) whereby when the first pump plunger (1) is driven by the first drive means (4) from the bottom dead centre to top dead centre the second pump plunger (11) is driven by the coupling means (30) from the top dead centre to bottom dead centre and as the second pump plunger (11) is driven from bottom dead centre to top dead centre by the second drive means (14) the first pump plunger (1) is driven from top dead centre to bottom dead centre by the coupling means (30).

2. A fuel pump as claimed in claim 1, wherein the coupling means (30) comprises a rocker arm (31) pivotally mounted on a shaft (32) secured to the body (9) of the pump.

3. A fuel pump as claimed in claim 2, wherein each pump plunger (1,11) includes a head (26) one side of which is acted on by the associated drive means (4,14) to drive the pump plunger (1,11) from bottom dead centre to top dead centre and the other side (39) of which acts on the rocker arm (31) as the plunger (1,11) moves from bottom dead centre to top dead centre.

4. A fuel pump as claimed in claim 3, wherein a slipper member (37) is interposed between the said other side (39) of the head (26) and the rocker arm (31) to accommodate movement of the rocker arm (31) laterally of the axis of the pump plunger (1,11) as the pump plunger reciprocates.

5. A fuel pump as claimed in claim 4, wherein the slipper member (37) has a flat face (38) in engagement with the said other side (39) of the pump plunger (1,11) and a part-spherical seat (36) which engages a complementary part-spherical surface (34) of the rocker arm (31).

6. A fuel pump as claimed in claim 1, wherein the drive means (4,14) each comprise a cam driven tappet.

7. A fuel pump as claimed in claim 6, wherein a slipper member (22) is interposed between each tappet (6,16) and one side of a head (26) of its associated pump plunger (1,11).

8. A fuel pump as claimed in claim 7, wherein the said one side of the pump plunger head (26) is part-spherical in the zone where it is engaged by the slipper member (22), and the slipper member (22) has a part-spherical surface complementary to that of the said one side of the pump plunger head (26).

9. A fuel pump as claimed claim 1, wherein the respective drive means (4,14) have respective cam members (5,15) mounted axially displaced from each other on a common drive shaft (27).

10. A fuel pump as claimed in claim 9, wherein the profiles of the respective cams (5,15) are such that as each pump plunger (1,11) is driven from the bottom dead centre to top dead centre, a tappet of the other pump plunger is maintained in or very close to sliding contact with its associated cam (5,15) by the action of the coupling means (30).

11. A fuel pump as claimed in claim 1, wherein the position of the coupling means (30) is adjustable to eliminate significant backlash between the various mechanical components of the pump plunger drive system.

12. A fuel pump as claimed in claim 2, wherein the rocker shaft (32) is mounted by means of an eccentric on the pump body (9) so that rotation of the rocker shaft (32) is effective to adjust the position of the rocker arm (31) to eliminate backlash.

13. A fuel pump as claimed in claim 1, wherein each pumping chamber (3,13) has associated therewith an electrically controlled discharge valve (54) which may be held open for a selectively variable portion of each return stroke of its associated pump plunger (1,11).

14. A fuel injection system for an internal combustion engine comprising a fuel pump, a common rail to which high pressure fuel is delivered by the pump, a plurality of injection valves; a fuel injection nozzle associated with each fuel injection valve, the fuel injection nozzles requiring a pre-determined minimum rail pressure to open; and a safety valve fluidically connected to the common rail, the safety valve having a pre-determined opening pressure and a pre-determined closure pressure less than the opening pressure, the pre-determined closing pressure being below the minimum rail pressure required to open the fuel injection nozzles.

15. A fuel injection system as claimed in claim 14, wherein:

the fuel pump includes, first and second pump plungers slidably mounted in respective first and second cylinders to define respective first and second pumping chamber, first drive means for driving the first pump plunger from a bottom dead centre position to a top dead centre position to deliver fuel from the first pumping chamber, and coupling means mechanically coupling the first pump plunger to the second drive means and the second pump plunger to the first drive means, whereby when the first pump plunger is driven by the first drive means from the bottom dead centre to top dead centre, the second pump plunger is driven by the coupling means from the top dead centre to bottom dead centre, and as the second pump plunger is driven from the bottom dead centre to top dead centre by the second drive means the first pump plunger is driven from top dead centre to bottom dead centre by the coupling means.

16. A fuel injection system as claimed in claim 14, wherein the safety valve (64) is incorporated within the fuel injection pump.

17. A fuel injection system as claimed in claim 14, wherein the fuel injection pump includes a flow restriction device which limits the rate of flow of fuel from the common rail or accumulator supplied by the pump in response to opening of the safety valve or the controlled maintenance of an open state of the discharge valves.

* * * * *